US005533552A

United States Patent [19]

Ahlers

[11] Patent Number: 5,533,552

[45] Date of Patent: Jul. 9, 1996

[54] BOTTLE FILLING MACHINE AND A CLEANSING SYSTEM ACCESSORY INCLUDING AN OPERATOR THEREFOR

[75] Inventor: Egon Ahlers, Neutraubling, Germany

[73] Assignee: Krones AG, Neutraubling, Germany

[21] Appl. No.: 359,420

[22] Filed: Dec. 20, 1994

[30] Foreign Application Priority Data

Dec. 23, 1993 [DE] Germany ..... 9319866 U

[51] Int. Cl.[6] ..... B67C 3/00; B67C 3/22

[52] U.S. Cl. ..... 141/144; 141/89; 134/170

[58] Field of Search ..... 141/85, 87, 89, 141/90, 91, 92, 311 A, 144, 145; 134/170

[56] References Cited

U.S. PATENT DOCUMENTS 4,967,812 11/1990 Herzog ..... 141/311 A
5,095,958 3/1992 Tincati ..... 141/89

FOREIGN PATENT DOCUMENTS 2804423 8/1979 Germany ..... B67C 3/00
3722495 1/1989 Germany ..... B67C 3/22

*Primary Examiner*—Henry J. Recla
*Assistant Examiner*—Steven O. Douglas
*Attorney, Agent, or Firm*—Ryan, Maki, Mann & Hohenfeldt

[57] ABSTRACT

In a bottle filling machine having a toroidal liquid tank and several filling units arranged circularly about the tank, each filling unit has a support which can be moved radially by means of an actuator. Each movable support supports a liquid flow inverter cup which can be connected to the filling unit for closing the opening of the gas return tube of the unit when cleansing solution is circulated through gas and liquid passageways of the machine. The converter cup, during a normal filling operation, is parked behind a circular barrier wall which is mounted radially inwardly from the filling units for surrounding the inverter cups and their movable support members during normal bottle filling operations. There is a doorway hole in the barrier wall aligned with each movable inverter cup support and a door is mounted to the movable support so that it keeps the doorway closed during regular bottle filling operations. In this way, the movable supports and the inverter cups thereon are protected against damage and soiling when they are in parked position.

15 Claims, 3 Drawing Sheets

BOTTLE FILLING MACHINE AND A CLEANSING SYSTEM ACCESSORY INCLUDING AN OPERATOR THEREFOR

BACKGROUND OF THE INVENTION

The invention disclosed herein pertains to a machine for filling bottles with liquid and, in particular, pertains to an improvement in the devices involved in cleansing and sterilizing the machine.

A typical high production machine for filling dozens of bottles simultaneously comprises a rotationally driven toroidal tank in which the filling liquid is stored under gas pressure. A plurality of filling units are mounted at equiangular spacing around the periphery of the tank. A turntable is positioned under the tank and rotates about the same axis. The turntable carries a circular array of bottle support disks equal in number to the number of filling units mounted to the tank. The disks are mounted to elevate the bottles to effect a seal between the mouth of the bottle and the filling unit before the bottle is subjected to pressurizing gas and before the liquid valve is open in the filling unit to allow liquid to flow into the bottle by gravity. The bottles on a linear conveyor are usually transferred by means of a warm conveyor to an infeed starwheel. The starwheel transfers the bottles to the bottle supports after which the bottles are lifted to seal to and be filled from the filling unit. After any particular bottle orbits around the tank, the lifting device that supports it is lowered and the bottle is transferred to an outfeed starwheel which may release the bottle successively to another linear conveyor.

There is a substantial amount of mechanisms involved in rotating the tank and controlling the lifting devices under the toroidal tank and within the confines of the circular array of filling units.

After the machine has made a long bottle filling run, it is stopped and prepared for cleansing and sterilizing it. Part of the cleaning operation involves removing all bottles from the machine and connecting the various passageways that conduct liquid and gases in the machine to a source of cleansing liquid. In a counterflow bottle filling machine, during normal filling operation, a gas injection and return tube is associated with each filling unit. Also, within the filling unit, there is a valve that allows liquid to flow after the injection and return tube has pressurized the interior of the bottle with an inert gas such as carbon dioxide. Every filling unit has some passageways connected to access liquid and gas from the toroidal storage tank. These passageways must be sterilized periodically. The gas injection and return tubes are, of course, open to the atmosphere before the backwashing or cleansing and sterilizing operation is to begin. The open ends of the gas tube must be blocked before the system is flushed with sterilizing and rinsing liquids. The most elementary approach to preparation for cleaning involves manually mounting a cup-like diverter member to each of the filling unit outlets to close off the end of the gas tube. During the filling operation, liquid is forced into the diverter cups and, because of the way the cups are connected, the flow direction of the incoming cleansing liquid is inverted or reversed and flows back into the various liquid and gas passageways for cleaning them. In the most advanced preexisting machines, there is a cylindrical shell or barrier wall mounted under the toroidal tank for protecting mechanisms inside of the barrier wall against splashing liquid and glass fragments that may be propelled by bottles that are cracked and explode when pressurized. In most prior machines, the diverter cups that are used in the washing and sterilization operation are parked outside of the barrier wall so that they can be undesirably filled with errant liquid as well as glass chips that are incidental to breakage of bottles occasionally during ordinary liquid filling runs. The completely unprotected diverter cups can themselves be damaged and soiled under normal filling machine operating conditions. Moreover, when the diverter cups are permanently parked outside of the barrier wall, they interfere with cleaning and sterilizing exterior surfaces of the machine in the filling unit region. This is undesirable because it is likely to result in improperly sterilized areas rather than germ-free areas. In other preexisting machines, the diverter cups are mounted directly on the bottle raising and lowering devices as in German Patent DE-OS 3722 495 or, in other preexisting machines, the diverter cups are mounted on the areas for the filling units as in German Patent DE-OS 2804 428.

SUMMARY OF THE INVENTION

An objective of the invention disclosed herein is to protect the diverter cups and their associated positioning mechanisms against physical damage and soiling.

According to the invention, the supports and the advancing and retracting mechanism for the inverter cups and the inverter cups themselves are parked when not needed completely behind a barrier wall in which there are doorways or openings having covers or doors that conceal the inverter cups until they are advanced through the door for being coupled to the respective filling units. Thus, the inverter cups and their supports are not susceptible to being contacted by glass fragments or splashing liquid as is inevitable under normal filling machine operating conditions. Moreover, because the inverter cups and associated mechanisms are inside of the circular protective barrier wall, the outside of the wall is smooth and without any structures that would make it more difficult to clean the area being sprayed with disinfecting agents and clean rinsing water.

The invention is not limited to using a circular barrier wall having a closable doorway for each inverter cup and its support to advance or emerge to connect with the filling units and to retract to parked position, but, in addition, it is contemplated that a continuous completely circular opening can be provided by an annular diaphragm which is concentric to the barrier wall and can be lowered to provide a completely circular opening for allowing the inverter cups to be advanced to operative position.

It is also contemplated that each filling unit may have its own opening or doorway and a cover. An advantage of this is that weakening of the barrier wall by having a due to the large number of doorways can be avoided.

The individual doors or covers can be biased with a spring whose force is overcome when the parked inverter cups are pushed through the doorway on their supports for being connected to the filling units. Further, according to another implementation of the invention, each cover or door may be attached to the outboard end of the support that translates the inverter cup to active position. In this way, mounting the individual doors or covers to the barrier wall is avoided.

How the foregoing objectives and features of the invention are implemented will appear in the ensuing more detailed description of a preferred embodiment of the invention which will now be set forth in reference to the drawings.

DESCRIPTION OF A PREFERRED EMBODIMENT

Figure 1:
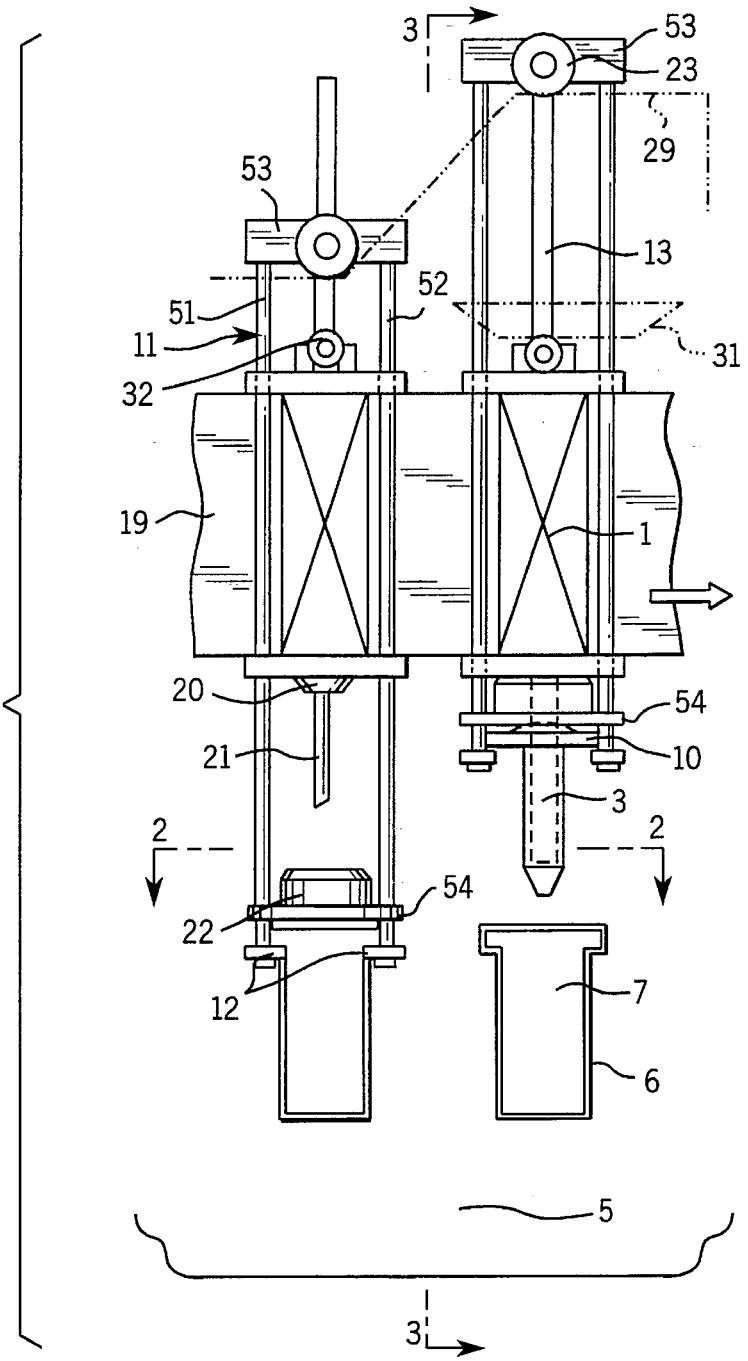
FIG. 1 shows two of the plurality of bottle filling units of a filling machine where one of the units is elevated on a cam and is conditioned for being washed and sterilized and the other of the exhibited units is not yet in such condition.
Figure 2:
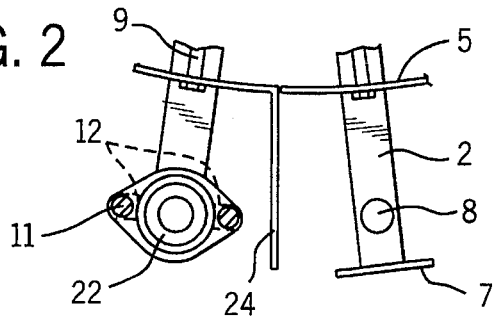
FIG. 2 is a transverse section taken on the line corresponding to 2—2 in FIG. 1.
Figure 3:
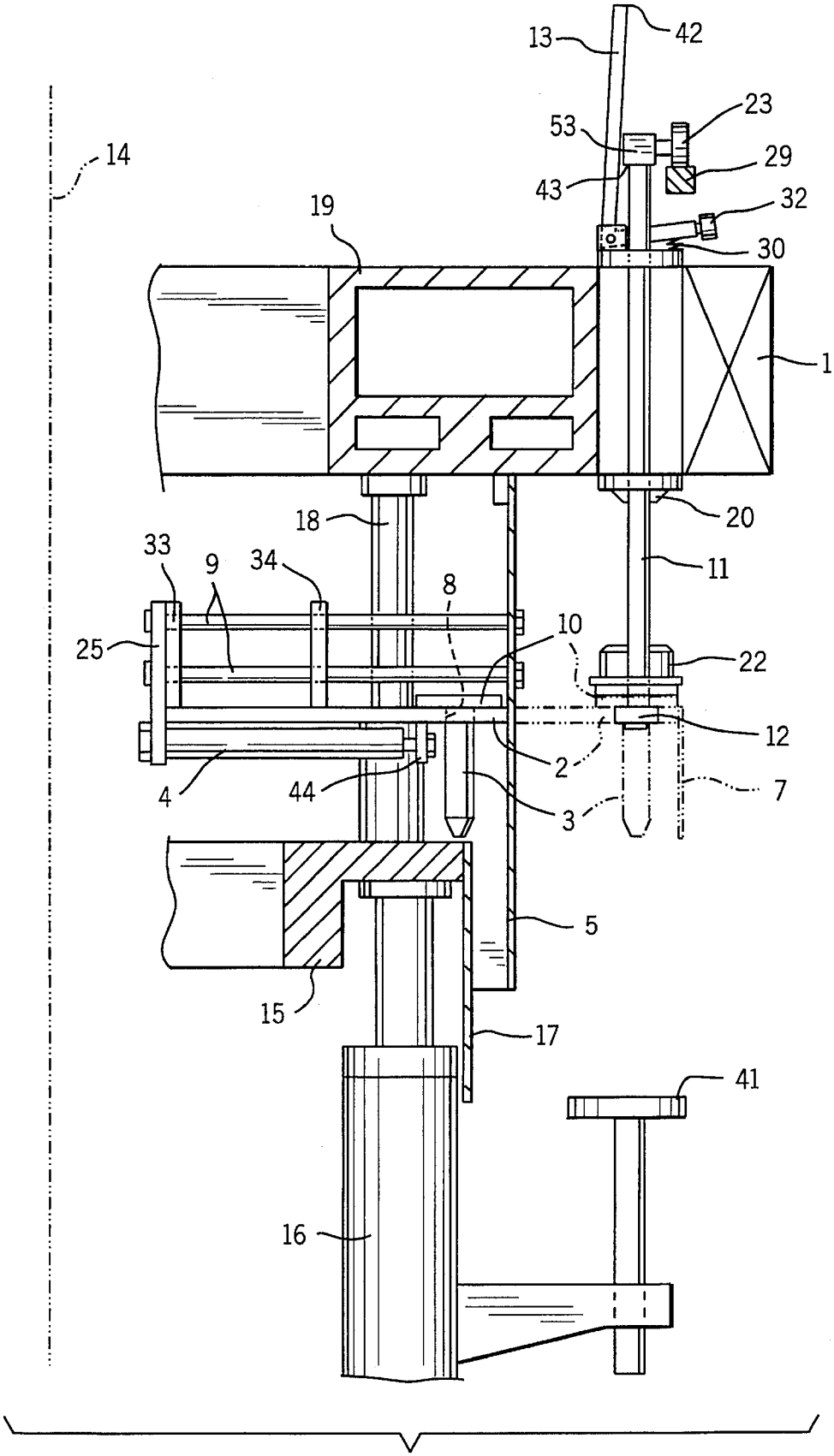
FIG. 3 is a vertical section taken on a line corresponding to 3—3 in FIG. 1.

The filling machine parts depicted in FIGS. 1–3 are involved in filling glass bottles, not shown, with a carbonated beverage under pressure. As shown in FIG. 3, the machine may have a conventional turntable 15 which is represented by a fragment of its periphery and which rotates about a vertical axis indicated by the dot-dash line marked 14. A plurality of equiangularly spaced apart bottle lifting and lowering devices 16 are mounted to the turntable. During regular machine operation wherein bottles are being filled, the bottles are delivered to the bottle supporting disks 41 from an infeed starwheel, not shown. In preparation for performing the cleansing and sterilizing operation, all bottles are removed from the machine and any of the stored beverage in toroidal beverage and gas storage tank 19 is drained out. The cams which drive the bottle lifting device 16 up and down are not shown in FIG. 3. An annular sheet metal shield 17 is mounted to turntable 15 and serves as a protective partial shield for the bottle lifting and lowering device 16.

The turntable 15 is supported on several vertical screw spindles or jacks 18 to adjust the machine for handling bottles of different types and heights. The spindles 18 are concentric with the rotational axis 14 of the turntable. The toroidal or cylindrical tank 19 has individual compartments for holding liquid, pressurized gas such as carbon dioxide, and return gas that is displaced from bottles by the liquid flowing into bottles during the filling operations. Several bottle filling units, generally designated by the numeral 1, are attached to and equiangularly spaced around the cylindrical periphery of toroidal tank 19. There is a bottle supporting disk 41 located below each filling unit 1. The filling units, as is visible in the left unit in FIG. 1 have at their respective lower ends, have a seal 20 to which the mouth of the elevated bottle seals during a filling operation. A gas injection and return tube 21 extends concentrically through seal 20. It is the lower open tip of gas tube 21 which must be surrounded sealingly with the diverter cups 3 before the machine cleaning and sterilizing operation can begin. The filling units 1 are equipped with unillustrated control valves or liquid, pressurized gas, return gas typically used with counterpressure bottle filling units.

As is evident in any FIGS. 1–3 each bottle filling unit has a sliding vertically reciprocable carriage 11 mounted to it. Each carriage comprises two parallel guide rods 51 and 52 tied together with cross bars 53 and 54. The sliding carriages 11 have at their lower ends a centering bell 22, and on their upper ends they have cam followers 23. The cam followers follow or move on the surface of a profile stationary control cam 29 to control the height position of the carriages, that is, the up and down movement of the sliding carriage 11 and anything appended to the carriages.

As can be visualized best in FIG. 3, an L-shaped lever 13, sometimes called a bolt, is pivotally mounted at the upper end of each filling unit 1. During regular bottle filling operation, a compression spring 30 prevents L-shaped lever 13 from contacting the cross bar 53 of carriage 11 as is shown in FIG. 3. The short, nearly horizontal leg of L-shaped lever 13 has a cam follower roller 32 mounted to it. Only during a cleaning operation cam follower 32 cooperates with a movable cam 31 which is depicted in phantom lines in FIG. 1. When the machine is operating in the bottle filling mode, cam 31 is simply parked in an inactive position with no possibility of being contacted by cam follower roller 32. When the machine is switched to the cleansing and sterilizing mode, cam 31 is moved, by mechanism that is not shown, into the path of the cam follower 32. In FIG. 3, the carriage 11 is not yet elevated to the height that must be obtained for a cleaning operation. In the right hand filler unit 1 shown in FIG. 1, the cam 31 has been moved into the position where it can push down on follower roller 32. During set up for the cleaning operation, only, of course, turntable 15 is rotating, which means that the upper cam follower roller 23 follows stationary cam 29 sufficiently to elevate the filler unit 1 to the desired level for performing the cleaning operation. In the right hand unit 1 in FIG. 1, the diverter cup 3 is already attached to the filler unit and the gas tube 21 is concentric with the interior of the diverter cup 3.

Now that cam 31 is in position, and the filler unit 1 is elevated, cam 31 presses down on follower roller 32. As mentioned, in FIG. 3, the carriage 11 is not yet elevated, but when it is elevated to conform with the right hand unit 1 in FIG. 1, the cross member 53 of the carriage will, of course, elevate and rub past the top corner 42 of the L-shaped locking lever 13. Since cam 31 is now pressing down on follower roller 32 against the force of spring 30, as the lower corner 43 of the cross member 53 passes corner 42 of lever 13, corner 42 can pivot under corner 43 of cross member 53, thereby holding carriage 11 suspended in its uppermost position in which it must be for performing the machine cleaning operation. Hence, the carriages 11 are all locked in upward limiting position as they pass under cam 31.

The carriages are elevated one by one as they pass over cam 29 and they stay in their uppermost position even after the, pass cam 31. Through a slight lift of the sliding carriage 11 over the control cam 29, after cleaning is finished the L-shaped lever 13 is automatically moved back into neutral position in which it is shown in FIG. 3 under the influence of compression spring 30. After the sliding carriage 11 is unlocked, it can be lowered by means of control cam 29 to its lower position.

In accordance with the invention, a cylindrical barrier wall 5 composed of stainless steel is attached concentrically with the axis of rotation to the underside of the toroidal tank 19. Barrier wall 5 is located radially inside of the circularly arranged filling units 1 and radially inwardly of the sliding carriages 11. The lower margin of the circular barrier wall 5 also overhangs and covers annular shield 17 on the turntable 15.

As is evident in FIG. 3, each filling unit 1 has associated with it two guide rods 9 which are behind and protected by barrier wall 5. A bar-like support member 2 is arranged in parallelism with guide rods 9. The support member 2 is mounted for sliding on guide rods 9 by means of bearing plates 33 and 34. A bracket 44 is fastened to sliding support 2 and extends downwardly for being fastened to the piston rod of a pneumatic cylinder 4. At its radially outwardly extremity, support member 2 is provided with a hole 8 as shown in FIGS. 2 and 3. The diverter cup 3 fits into hole 8.

The cup 3 has an integral disk 10 that supports the cup and is involved in sealing the cup to a filler unit. The lower end of inverter cup 3 is, of course, closed so that cleaning fluid descending out of the end of the gas tube 21 can become inverted or turned around and caused to flow upwardly within the cup and into the various passageways of the machine that need to be cleansed and sterilized. As shown in the FIG. 4 embodiment, the top surface of the cup disk 10 is provided with a sealing O-ring 35 and is fitted to the centering bell 22 in such a way that it can be connected leak free to the centering bell.

In FIG. 1, only a fragment of the barrier wall 5 is shown to illustrate that below each pair of rods 9 there is a doorway or opening 6 in barrier wall 5 through which a cup support 2 can move radially outwardly of the protective wall 5 when the filling machine is to be cleaned. The front part of each cup support 2 facing radially outwardly has a flat door or cover 40 which fits over the opening 7 and closes the opening flush with the barrier wall 5 when its cup 3 support 2 is retracted in parked position behind the barrier wall. The door or cover 7 has a T-shaped configuration whereby the cross member of the T corresponds in length with the diameter of the cup disk 10.

During normal bottle filling operation of the machine, all supports 2 and inverter cups 3 mounted on them are in the position represented in solid lines in FIG. 3. Hence, all supports 2 and inverter cups 3 are completely concealed behind the cylindrical barrier wall 5. The openings 6 through which the supports 2 must project to mount the inverter cups 3 on the carriages are closed by covers 7 during a bottle filling run. Thus, the support members 2 and the inverter cups 3 thereon are protected against any flying glass fragments or splashing liquid that may occur outside of the barrier wall 5. Since the movable support members 2 are stored behind the barrier wall 5, there are no devices remaining outside of the barrier wall except the filling units themselves so that the barrier wall is completely smooth on the outside and there is nothing present on the outside of the barrier wall that might interfere with the lifting motion of the bottles. Moreover, the smooth surface on the outside of the barrier wall below the filler units 1 makes it easy to clean and sterilize the barrier wall.

Preparation for conducting the cleaning-in-place process involves removal of all bottles from the machine and assuring that the toroidal tank 19 is completely drained of the beverage that is being bottled. The structures for bottle transport, which are not depicted, such as the bottle infeed starwheels and guide rails for infeed and discharge of bottles to and from the bottle lifting devices 16 can remain in position. The turntable 15 is then rotated slowly and in the region of rotation between the infeed and outfeed starwheels the sliding carriages 11 and the centering bells 22 thereon assume their lower position as in the left view in FIG. 1 and in FIG. 3. When the carriages 11 are in this lower position, all supports 2 will be driven by their drives 4 to move one after the other from the parked position and operating position radially outwardly of barrier wall 5. The cover 7 that is mounted to each of the supports 2 is carried by the supports 2 and, therefore, as soon as the latter begins to move radially outwardly, the openings 6 in the barrier wall are open for the supports 2 to pass through. The operating position of the supports 2 and the inverter cups 3 is depicted in FIG. 3 in dash-dot lines. FIG. 3 shows that the disk 10 of each inverter cup 3 is concentric with the centering bell. The disk contacts the centering bell at its underside with little freeplay in the sliding carriage 11. In the machine cleaning mode, the inverter cups 3 are retained on each sliding carriage 11 in contact with the centering bells 22 by means of a take-up clamping device 12. The take-up device 12 consists of two fingers which contact the bottom of the cup disk 10 on the side of the disk opposite from the side from which the inverter cup projects. In FIG. 3, the top side of the take-up device 12 is aligned with the top side of the support member 2. FIG. 1 shows that the take-up device 12 has a clear passageway from the inside to the outside in the radial direction so the inverter heads 3 which are moving radially with their supports 2 can enter the take up device 12. The specially configured opening 6 covers 7 which were previously between the fingers of the take-up device 12 can pass through the take-up device. Centering of the inverter cups 3 is achieved by reason of the cylindrical cups fitting into mounting hole 8 of cup support 2.

FIG. 1 shows that as soon as a carrier 11 acquires an inverter cup, with a cup hanging loosely in take-up device 12, further rotation of the turntable drives the carriage 11 up the ramp of stationary cam 29. This causes the disk 10 of inverter cup 3 to be pressed in a leak-free manner against the centering bell of the bottle filling unit 1. The inverter cups 3 are then fixed against moving laterally by mounting holes 8 and return gas tubes 21. Then, as previously discussed, appropriately positioned cam 31 causes the cam follower 32 to be pressed downwardly such that with the cross member 53 of the carriage 11 being in its uppermost position, the edge 42 of the L-shaped lever 13 can catch under the corner 43 of cross member 53. This keeps the carriage 11 in suspension as the turntable slowly rotates away from cam. 31. After all of the carriages 11 are latched in their uppermost position, the customary cleaning-in-place (CIP) method is initiated wherein a cleaning liquid is pumped through the areas liquid and gas passages of the filling machine and through sealing nozzle 20 into the inverter cups from which the cleaning liquid emerges, changes direction and continues circulating through the system. After a predetermined length of cleaning time, the cleaning liquid and pure rinsing water that follows it is blown off and the sliding carriages 11 are lowered by successive disengagement of the L-shaped latching levers 13. At that time, the tapered lower ends of the cylindrical inverter cups 3 in the take-up devices 12 enter the mounting holes 8 and continue their descent until the disks 10 of the inverter cups come to rest on supports 2. At this time, the radially movable support members 2, now carrying the inverter cups, are retracted back into their parked position behind the barrier wall by pneumatic cylinders 4. Then, each inverter cup 3 moves radially inwardly of the take-up device 12 and through opening 6 in barrier walls until the hole or doorway 6 is finally closed by its cover or door 7.

During the cleaning operation, the supports 2 can remain in their operative position or can be retracted into parked position behind barrier wall 5. Operating and parked positions are determined by movable supports 2 striking plates 33 and 34 which are attached to the upper end of each support 2 and are slidable on rods 9. The plates 33 and 34 cooperate with a connecting plate 25 between the pneumatic cylinder 4 and the guide rods 9 on one hand and with the barrier wall 5 on the other hand.

Figure 4:
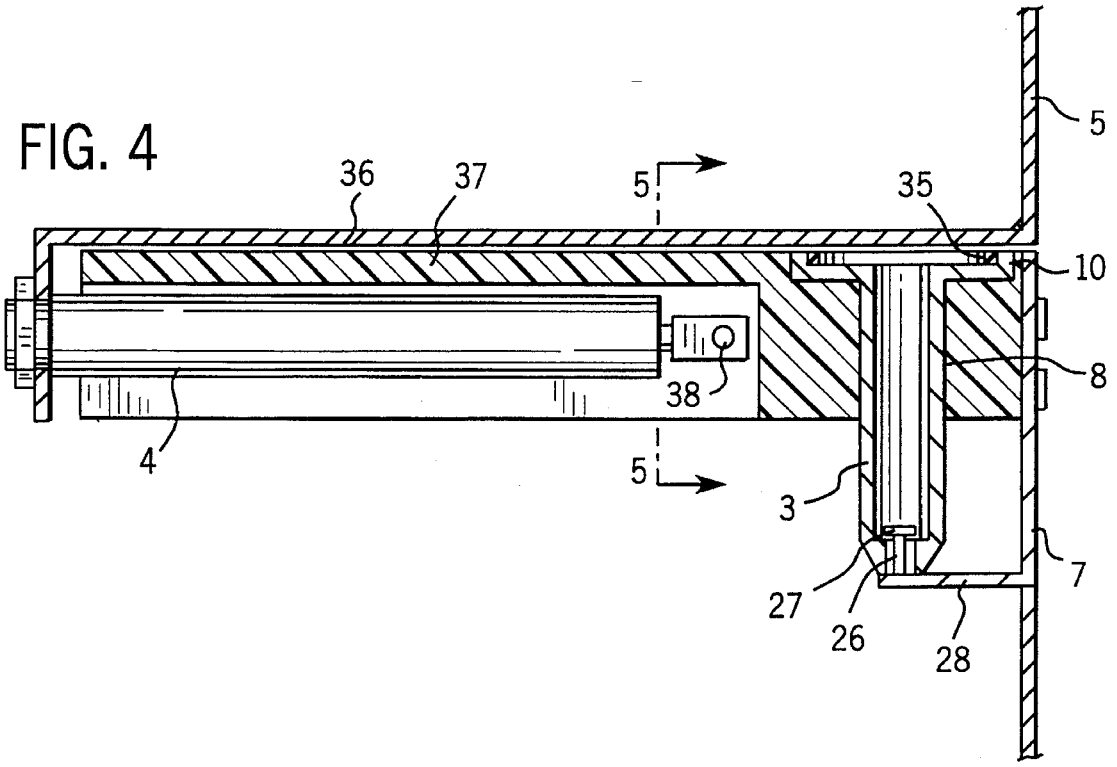
FIG. 4 is a side-elevational view of an alternative embodiment of an inverter cup and its supporting end actuating mechanism.
Figure 5:
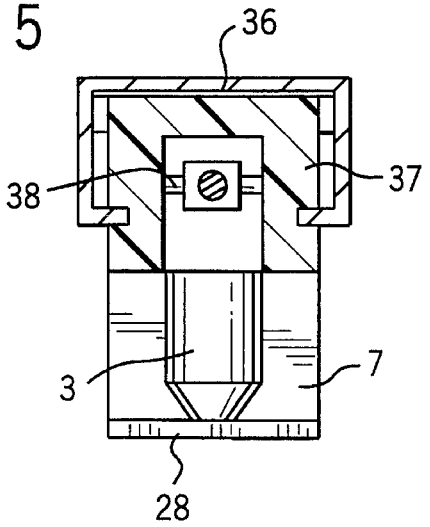
FIG. 5 is a vertical section taken on a line corresponding to 5—5 in FIG. 4.

A modified version of the mechanism for moving the converted cups 3 from parked position to active position and vice-versa is shown in FIGS. 4 and 5. In FIG. 4, fragments of the barrier wall 5 are shown. The structure depicted in FIG. 4 is mounted under each filling unit 1 radially inwardly of the barrier wall 5. A horizontal radially extending support member 36 having a C-shaped cross sectional configuration is open on its bottom. A support member 37 is mounted for sliding on C-shaped support 36. Support 37 is preferably composed of plastic material. There is a hole 8 at one end of support member 36 for accommodating an inverter cup 3. The mounting hole 8 is enlarged at its upper end to accommodate the disk portion 10 of the inverter cup. The upper disk portion 10 of the inverter head 3 aligns with the upper portion of the support 37 and resides in parked position under the closed top side of member 36 which, thus, serves as a cover. In this way, any foreign material through which the interior of the inverter cups 3 may be exposed is avoided.

The two-way operating pneumatic cylinder 4 is also protected inside of support member 37. The guide member or support 36 is attached at one end to the free front side of the member 36. The other end of the pneumatic cylinder is attached to support 37 by means of a pin 38.

In FIG. 4, the inverter cup 3 has a drain opening 26 at its lower end. A vertically movable valve body 27 has a stem projecting through drain opening 26. When the inverter cup hangs freely in its take-up device 12, the valve body closes off the drain opening 26 by its own weight. However, when the inverter cup is in its mounting hole 8, the valve body 27 is held open by a control member 28 in the form of a horizontal ledge at the lower end of cover 7 so that the final rinsing liquid can run out of the cup after the cup is retracted and the machine cleaning operation is ended. The cover 7 is then attached to the radially outward front side of support 37.

As indicated in FIG. 2, the barrier wall 5 can also be composed of individual segments which can have separating wall portions 24 between the bottles supported on the filling units 1. The take-up and pressing of the converter cups into their operating position can be obtained by means of lifting elements 16 or through other appropriate lifting drives, connected with the supports. The rinsing heads remain in their supports while in their operating position.

I claim:

1. A container filling machine comprising:

a generally circular storage tank (19) having radially outwardly facing periphery that is concentric to a vertical axis (14), a turntable (15) supporting the tank for the turntable and tank to rotate about said vertical axis, a plurality of container filling units (1) mounted to and equiangularly spaced apart around the periphery of the tank, a vertically extending generally circular barrier wall (5) mounted for rotating with the tank and the container filling units thereon, the barrier wall is positioned radially inwardly of the filling units on the tank, guide structures (9,36) corresponding in number with the number of filling units (1) fixedly mounted in the space in the machine circumscribed by the barrier wall, each guide structure having a cup support (2,37) and a closure cup (3) mounted thereon for the support to be advanced on the guide structure from a parked position radially inwardly of the barrier wall (5) through an opening in the barrier wall and radially outwardly of the barrier wall to an active position for the cups to couple to the filling units, respectively, an actuator operative to advance said cup support to active position and to retract said closure cup support to parked position, and a cover (7) moved to close the opening in the barrier wall (5) in response to the support (2,37) becoming fully retracted.

2. The container filling machine according to claim 1 wherein each filling unit (1) is adjacent its own opening in the barrier wall (5) and covers close the respective openings in response to the support member (2,37) becoming fully retracted.

3. The container filling machine according to claim 2 wherein each said cover (7) is sized and shaped for passing into a said opening (6) with a small clearance and each said cover has a radially outwardly presented surface that becomes substantially flush with the radially outwardly presented surface of the barrier wall (5) when the support (2,37) is retracted to said parked position.

4. The container filling machine according to claim 2 wherein the cover (7) is sized and shaped slightly larger than the opening (6) such that margins of the cover are defined and the margins overlap the barrier wall (5) around the opening when the support (2,37) is retracted to said parked position.

5. A container filling machine according to any one of claims 1 or 2 wherein the cover (7) is attached to the radially most outwardly remote end of the cup support (2,37) for closing said opening when the cup support is fully retracted to said parked position.

6. The container filling machine according to any one of claims 1 or 2 wherein the covers (7) are mounted to the cup supports so the covers are removed from the openings when the supports (2,37) begin to advance and the covers reclose the openings when the supports are fully retracted to said parked position.

7. A container filling machine according to claim 1 wherein each said cup support (2,37) has a mounting hole for releasably supporting a cup (3).

8. The container filling machine according to claim 1 wherein:

said guide structures are comprised of at least one elongated guide rod member (9,36) fixedly mounted to the barrier wall (5) and said cup support (2,37) is mounted slidably on the elongated rod member and is retractable radially along said rod member.

9. A container filling machine according to claim 8 wherein said elongated guide rod member (36) has a C-shaped cross section which is arranged with the opening of the section facing downwardly, said cup support (37) is slidable on said rod member (36) and said support is covered by said rod member (36) when the support is retracted to said parked position such that the cup (3) on the support member is also covered and protected by the rod member (36).

10. A container filling machine according to claim 9 wherein:

said cup (3) has a lower end in which there is a drain hole (26) providing a valve seat and there is a valve element (27) having a stem extending through the drain hole, and a valve operating member (28) on support (37) against which member said stem makes contact when the cup (3) is inserted in the support (12), said contact raising the stem to separate the valve element from the seat so any liquid in the cup can drain out.

11. A container filling machine according to claim 10 wherein:

said rod member (36) is mounted to the barrier wall (5), there is an opening in the barrier wall next to the rod member (36) and the cup (3) support member (37) is slidable on the rod member, a cover (7) is mounted to the slidable support member (37) in a position for closing the opening when the support member is fully retracted to said parked position, and said valve operating member (28) is a laterally extending member joined with the door and providing a surface for operating the valve element when contacted.

12. A container filling machine according to claim 1 wherein said actuator is a pneumatic cylinder.

13. A container filling machine according to claim 1 including:

a carriage (11) assembly proximate to each filling unit (1) and mounted for moving up and down relative to a said filling unit (1), the carriage having upper (53) and lower (54) ends and a receptacle (12) for receiving and retaining a cup (3) at its lower end (54) and having a cam follower (23) at its upper end, a stationary cam (29) fixedly mounted in the machine and constructed and arranged for cooperating with said cam follower (23) in response to rotation of said turntable (15) to raise said carriage (11) and seal said cup (3) releasably to said filling unit (1).

14. A container filling machine according to claim 13 wherein:

said cup (3) has an integral collar (10), said receptacle (12) having fingers that engage the collar for pressing the cup into sealing relation with the filling unit (1) when the carriage is raised.

15. A container filling machine according to claim 13 including:

a locking lever (13) pivotally mounted to each filling unit (1), a cam follower roller (32) mounted to the locking lever and a spring member arranged for urging said locking lever to pivot in one direction, another cam (31) movable to a position wherein it acts on the cam follower roller (32) in response to rotation of the turntable to set the lever in locking condition with said upper end (53) of the carriage (11) to thereby retain the carriage in an elevated condition.

* * * * *